US008025760B2

(12) United States Patent
Hernesniemi et al.

(10) Patent No.: US 8,025,760 B2
(45) Date of Patent: Sep. 27, 2011

(54) FEEDER

(75) Inventors: Lasse Hernesniemi, Pietarsaari (FI); Torbjörn Jacobsson, Sundsvall (SE); Peter Danielsson, Fagervik (SE); Anders Jonsson, Söråker (SE)

(73) Assignee: Metso Paper, Inc. (FI)

( * ) Notice: Subject to any disclaimer, the term of this patent is extended or adjusted under 35 U.S.C. 154(b) by 866 days.

(21) Appl. No.: 11/989,702

(22) PCT Filed: Sep. 8, 2006

(86) PCT No.: PCT/FI2006/050385

§ 371 (c)(1),
(2), (4) Date: Jan. 30, 2008

(87) PCT Pub. No.: WO2007/036603

PCT Pub. Date: Apr. 5, 2007

(65) Prior Publication Data

US 2009/0090477 A1 Apr. 9, 2009

(30) Foreign Application Priority Data

Sep. 27, 2005 (FI) ..... 20055513
Apr. 28, 2006 (FI) ..... 20060407

(51) Int. Cl.
*D21C 1/10* (2006.01)

(52) U.S. Cl. ..... 162/52; 162/259; 162/264; 162/338; 162/380

(58) Field of Classification Search ..... 162/52, 162/259, 264, 338, 380
See application file for complete search history.

(56) References Cited

U.S. PATENT DOCUMENTS

| | | | | |
|---|---|---|---|---|
| 2,459,180 | A | | 1/1949 | Richter |
| 2,688,416 | A | | 9/1954 | Skretting |
| 2,870,009 | A | | 1/1959 | Richter |
| 2,901,149 | A | | 8/1959 | Richter |
| 3,041,232 | A | | 6/1962 | Richter et al. |
| 3,411,986 | A | | 11/1968 | Buchberger et at |
| 3,758,379 | A | * | 9/1973 | Reinhall ..... 162/246 |
| 4,033,811 | A | | 7/1977 | Gloersen |
| 4,338,049 | A | | 7/1982 | Richter et al. |
| 4,430,029 | A | | 2/1984 | Richter et al. |
| 4,508,473 | A | | 4/1985 | Richter et al. |
| 4,516,887 | A | | 5/1985 | Richter et al. |
| 5,236,285 | A | | 8/1993 | Prough |
| 5,236,286 | A | | 8/1993 | Prough |
| 5,476,572 | A | | 12/1995 | Prough |
| 5,635,025 | A | | 6/1997 | Bilodeau |
| 5,662,598 | A | | 9/1997 | Tobin |
| 5,736,006 | A | | 4/1998 | Prough |
| 5,744,004 | A | | 4/1998 | Ekholm et al. |
| 5,753,075 | A | | 5/1998 | Stromberg et al. |
| 5,766,418 | A | | 6/1998 | Prough |
| 5,795,438 | A | | 8/1998 | Stromberg et al. |
| 6,368,453 | B1 | | 4/2002 | Kettunen et al. |
| 6,468,006 | B1 | | 10/2002 | Prough |
| 6,616,384 | B2 | | 9/2003 | Prough |
| 6,669,410 | B2 | | 12/2003 | Prough |
| 2001/0025694 | A1 | | 10/2001 | Kettunen et al. |

* cited by examiner

*Primary Examiner* — Matthew Daniels
*Assistant Examiner* — Jacob Thomas Minskey
(74) *Attorney, Agent, or Firm* — Lerner, David, Littenberg, Krumholz & Mentlik, LLP

(57) ABSTRACT

A fluid transfer apparatus for bulk material is disclosed. The transfer apparatus includes a rotor mounted on a rotatable shaft and including axially extending flow channels extending through the rotor parallel to the shaft, flow connectors for connecting a low-pressure flow of fluid and a high-pressure flow of fluid into and out of the axially extending flow channels, a casing enclosing the rotor, a pair of axially sealing plates disposed between the ends of the rotor and the casing, a pressurizing fluid fed into the chamber defined by the casing to pressurize the rotor, the flow connectors, and the axially movable sealing plates.

16 Claims, 5 Drawing Sheets

FEEDER

FIELD OF THE INVENTION

This invention relates to a transfer device for transferring bulk material from one pressure level system to another pressure level system. More precisely, this invention relates to a feeder to feed wood chips in a liquid at low pressure into a digester operating at high pressure. The present invention also relates to a method for sealing the transfer device.

BACKGROUND OF THE INVENTION

In the following discussion, the feeding systems currently being used to feed low-pressure slurry into a digester operating at high pressure will be briefly described with reference to a number of patents disclosing the known devices and processes in more detail. Also, the problems related to the present feeders, to their construction or to the use of these feeders, will be discussed.

The continuous pulping process was developed in the 1940s and 1950s. Since then, no dramatic improvements have been made to the equipment for transferring the comminuted cellulosic material to the digester. The High-Pressure Feeder (HPF) has been used for decades for feeding a slurry of wood chips into the treatment vessel, and it still seems to be an object of further developments. The HPF is a rotary valve-type device, which transfers the slurry of material and liquid at one pressure to a second, higher pressure. The transfer is performed with the aid of circulation pumps. One advantage of the HPF is its capability of acting as a pressure isolation valve, by preventing the high-pressure material from escaping to the low-pressure side, or to the surrounding environment.

Although the main concept of the HPF has remained unchanged during these years the development of the feeder has been continuous. There are numerous patents describing different progress steps of HPF, for example the following: U.S. Pat. Nos. 2,459,180; 2,688,416; 2,870,009; 2,901,149; 2,914,223; 3,041,232; 4,033,811; 4,338,049; 4,430,029; 4,508,473 and 4,516,887. U.S. Pat. Nos. 5,236,285 and 5,236,286 describe the design of the High-Pressure Feeder in the mid 1990s. Examples of recent developments are disclosed in U.S. Pat. Nos. 6,468,006, 6,616,384 and 6,669,410.

In a continuous digesting system the method for feeding comminuted cellulosic material into the pressurized treatment vessel has proved to be a very demanding part of the process. The HPF with only relatively few substantive changes in its design has been the central part of the feeding system of the Kamyr continuous pulping system. It seems to have been difficult, if not impossible, to solve the bottlenecks of the HPF, for example the low density of bulk material inside the feeder. Attempts have been made to enhance the efficiency by developing the method of chip feeding as a whole. The method, marketed under the name LO-LEVEL® Feed System, by Andritz simplifies the system around the HPF. This feed system is described for example in the following U.S. Pat. Nos. 5,476,572; 5,622,598; 5,635,025; 5,736,006; 5,753,075; 5,766,418 and 5,795,438. Recent developments further simplify the equipment related to the feeding system by eliminating the need for a separate liquor storage vessel and a separate level controlling vessel or tank. This system with a single tank is described in the U.S. Pat. No. 6,368,453, in a divisional application US2001/0025694A1 and in its five other divisional applications.

One bottleneck in the present High Pressure Feeders is the reduction in the pocket cross-sectional area in the middle of the pocket as a consequence of the crosswise placed pockets within the rotor. Due to this reduction of the pockets more flushing is needed to avoid plugging.

The design of the present high-pressure feeder is conical, in terms of both the rotor and the housing. When the wear parts have to be repaired the wear surfaces have to be weld repaired and machined afterwards.

There are typically four pockets per revolution in the present high-pressure feeder so the filling and emptying frequency is low, meaning that the rotating frequency is quite low (maximum 15-18 rpm) and therefore the specific oscillating frequency is low and differs only slightly from the specific oscillating frequency of the building itself, resulting in a wobble phenomenon. The low rotating frequency also reduces the capacity of the feeder.

Also, the manually adjusted seal gap between the housing and the rotor contributes to leakage and wear problems with the HPF.

The manufacturing costs of present high-pressure feeders are high in relation to the capacity obtained. The construction of the pockets is complicated and the feeder construction as a whole has to be very rigid due to asymmetrical loads on the rotor during the filling and emptying of the pockets, both of which increase the manufacturing costs.

In the mid 1990's Kvaerner introduced a feeding system, disclosed in U.S. Pat. No. 5,744,004, that was not based on the use of a feeder operating as a sluice between the low pressure and high pressure sides. Instead, a pump or a series of pumps was used, which comprises a stack, or so called disc pack, consisting of a number of parallel discs held together and rotating in a pump housing about a common axis of rotation. One of the pumps coupled in series is arranged so that it can be rotated with a variable speed of rotation in order to regulate the pressure in the digester. These pumps are known under the trade name DISCFLO.

In U.S. Pat. No. 3,758,379, a type of revolver feeder is described, for example, for the handling of cellulose-containing material. The feeder according to that invention comprises a rotor having a plurality of spaces extending axially through the rotor in different positions of the rotor, which spaces are brought into communication with openings formed in end plates contacting the rotor. The feeder comprises a feed end plate and a discharge end plate, which are interconnected by drawbars equally spaced about the circumference of the end plates outside the rotor. According to the specification of U.S. Pat. No. 3,758,379, the unbalanced pressure forces acting on the end plates cause a problem typical to these revolver-type feeder valves. These forces cause rapid and irregular wear of the opposing surfaces of the rotor and the end plates, which results in leakage between the spaces. According to U.S. Pat. No. 3,758,379 that problem is solved, in other words an essentially constant and uniform wear of the sealing surfaces is obtained, by using traction force producing devices disposed individually for all or those draw bars positioned adjacent the areas exposed to high outwardly directed pressure forces from the spaces. These traction force producing devices balance the pressure forces acting on the end plates and render the movement of the end plates uniform in relation to the ends of the rotor along the circumference of the rotor. According to this invention, each of the traction force-producing devices contains an automatically operative pressure control device to produce a traction force to counterbalance the increased pressure directed outwardly from the spaces of the rotor. To obtain the balanced contact, removable sealing discs are placed between the opposing faces of the rotor and the end plates. This type of feeder is very complicated and also expensive.

It is one of the objects of the present invention to provide a new transfer device for transferring bulk material from one pressure level system to another pressure level system, especially to provide a transfer device for feeding wood chips into a digester, a feeder, that transfers low-pressure slurry from the chip chute to the digester operating at high pressure. The above-described problems associated with prior art feeding systems can be solved with this new type of a feeder.

SUMMARY OF THE INVENTION

In accordance with the present invention, these and other objects have now been realized by the invention of a fluid transfer apparatus comprising a rotatable shaft, a rotor having a first end and a second end affixed to the rotatable shaft for rotation therewith, the rotor including a plurality of axially extending flow channels extending through the rotor substantially parallel to the rotatable shaft, a plurality of flow connectors for connecting a low-pressure flow of fluid and a high-pressure flow of fluid into and out of the plurality of axially extending flow channels, a casing defining a chamber enclosing the rotor, a pair of axially movable sealing plates disposed between the first and second ends of the rotor and the casing, and pressurizing means for pressurizing the chamber by feeding a pressurizing fluid into the chamber, thereby pressurizing the rotor, the plurality of flow connectors and the pair of axially movable sealing plates. Preferably, the fluid transfer apparatus includes seals for sealing the rotatable shaft.

In accordance with one embodiment of the apparatus of the present invention, the plurality of axially extending flow channels includes pressure equalizing openings communicating with the chamber through the rotor. Preferably, the pressure equalizing openings are adjustable.

In accordance with another embodiment of the fluid transfer apparatus of the present invention, the pressurizing means includes fluid flow means for controlling the flow of the pressurizing fluid out of the casing.

In accordance with another embodiment of the fluid transfer apparatus of the present invention, the apparatus includes sealing members disposed between the plurality of flow connectors and the pair of axially movable sealing plates for preventing leakage therebetween.

In accordance with another embodiment of the apparatus of the present invention, the rotatable shaft is axially movable.

In accordance with another embodiment of the fluid transfer apparatus of the present invention, the plurality of flow connectors comprises four flow connectors, and in another embodiment comprises eight flow connectors.

In accordance with the present invention, a method has also been discovered for sealing a fluid transfer apparatus including a rotatable shaft, a rotor having a first end and a second end affixed to the rotatable shaft for rotation therewith, the rotor including a plurality of axially extending flow channels extending through the rotor substantially parallel to the rotatable shaft, a plurality of flow connectors for feeding the fluid at a first pressure into and out of the plurality of axially extending flow channels and purging the fluid at a second pressure into and out of the plurality of axially extending flow channels, the first pressure and the second pressure being different pressures, the method comprising providing a casing defining a chamber for enclosing the rotor, providing a pair of axially movable sealing plates between the first and second ends of the rotor and the casing, and pressurizing the chamber thereby pressurizing the rotor, the plurality of flow connectors, and the pair of axially movable sealing plates by feeding a pressurizing fluid into the chamber, thereby forcing the pair of axially movable sealing plates against the first and second ends of the rotor. Preferably, the method includes pressurizing the chamber at a pressure greater than the first pressure and the second pressure.

In accordance with one embodiment of the method of the present invention, the method includes pressurizing the chamber with a pressurizing fluid such as white liquor, cooking liquor, black liquor, wash liquor, water, and mixtures thereof.

In accordance with another embodiment of the method of the present invention, the method includes pressurizing the chamber with a pressurizing fluid such as a gas or steam.

In accordance with another embodiment of the method of the present invention, the method includes removing the pressurizing fluid from the chamber.

In accordance with another embodiment of the method of the present invention, the method includes feeding the fluid at the first pressure and purging the fluid at the second pressure in accordance with the last-in first-out principle. In another embodiment, the method includes feeding the fluid at the first pressure and purging the fluid at the second pressure in accordance with the first-in last-out principle.

The present invention relates to a revolver type transfer device comprising a rotatable shaft with a rotor having a plurality of axial flow channels, running parallel to the shaft and extending through the rotor, and a casing enclosing the rotor, the device having connections for low-pressure flow into and out of the flow channels and for high pressure flow into and out of the flow channels. The side of the feeder where the low-pressure connections are located is called the low-pressure side and correspondingly, the side where the high-pressure connections are located is called the high-pressure side of the feeder.

The present invention concerns a revolver type transfer device for bulk material with a new type of sealing system. This feeder can be used to transfer, for example, steamed wood chips in a liquid at low pressure into a digester at high pressure. The transfer device according to the present invention comprises a rotatable shaft with a rotor with a plurality of axial flow channels parallel to the shaft inside the rotor, flow connections for low-pressure flow into and out of the flow channels and for high pressure flow into and out of the flow channels.

Thus, the device according to the present invention comprises a casing enclosing a rotor, axially movable sealing plates between the ends of the rotor and ends of the casing, means for pressurizing a chamber defined by the casing, the rotor on the shaft, the flow connections and the axially movable sealing plates, by feeding a pressurized fluid to the casing.

According to one embodiment of the present invention the feeder has one connection for low-pressure inlet and one connection for low-pressure outlet and correspondingly one connection for both high-pressure inlet and high-pressure outlet.

According to another embodiment of the present invention the number of connections in the feeder can be increased in order to enhance the capacity of the transfer device. The number of connections may be e.g. two for low-pressure inlet and two for low-pressure outlet and correspondingly, two for both high-pressure inlet and high-pressure outlet. The number of connections for inlet and outlet both in the low-pressure and high-pressure side of the feeder has to be equal.

In order to obtain sufficient sealing efficiency towards leakage from the chamber to the low-pressure or high-pressure side, the pressure inside the chamber is equal to or higher than that of the high-pressure side. The chamber pressure can be adjusted by allowing an amount of pressurizing fluid to escape from the chamber.

The axial flow channels may have adjustable pressure-equalizing openings communicating with the chamber through the rotor. Through these pressure-relief connections, the flow channels can "breathe" in order to avoid pressure shocks caused by abruptly stopping flows. Preferably, in the casing there is an opening through which the size of the pressure-equalizing openings can be adjusted, e.g by means of adjustment screws. The opening in the casing is closed during operation of the transfer device, but it can be opened if needed for adjustment of the pressure-relief connections during shutdown of the feeder.

The rotatable shaft can be arranged to be movable in its axial direction within certain limits, or the end bearing can be an axial bearing, in which case the shaft cannot be moved axially. Which of these alternatives is preferred depends on the object of the application or on the mechanical construction of the equipment.

Inside the connection or connections for feed-side outflow, a screen may be provided in each of the connections in order to prevent bulk material from escaping from the flow channel and to enhance the filling of the flow channels. The need for a screen depends mainly on the bulk material to be transferred, but also the speed of rotation of the rotor and the flow rate or a certain combination of these factors may influence the need to use a screen.

The present invention also relates to a new method for sealing a transfer device. T The pressurizing fluid acting in the pressurized chamber can be, for example, a gas e.g. compressed air, or steam, or it may be a liquid, examples being white liquor, cooking liquor, black liquor, wash liquor, water or a mixture of these, depending on the application. In the case of feeding wood chips, white liquor is preferred because of its lubricity, purity and availability. The pressure inside the chamber can be adjusted by allowing pressurizing fluid to flow out of the casing; preferably, the fluid is removed through a connection provided at the bottom of the casing.

These and the other objects of the present invention will become clear from the detailed description of the invention and from the appended claims. The following figures and examples are for illustrative purposes only and are not to be construed as limiting the instant invention in any manner whatsoever, but the scope of the protection is in accordance with the claims.

BRIEF DESCRIPTION OF THE FIGURES

The present invention may be more fully understood by reference to the following detailed description, which refers to the figures, in which.

DETAILED DESCRIPTION

Figure 1:
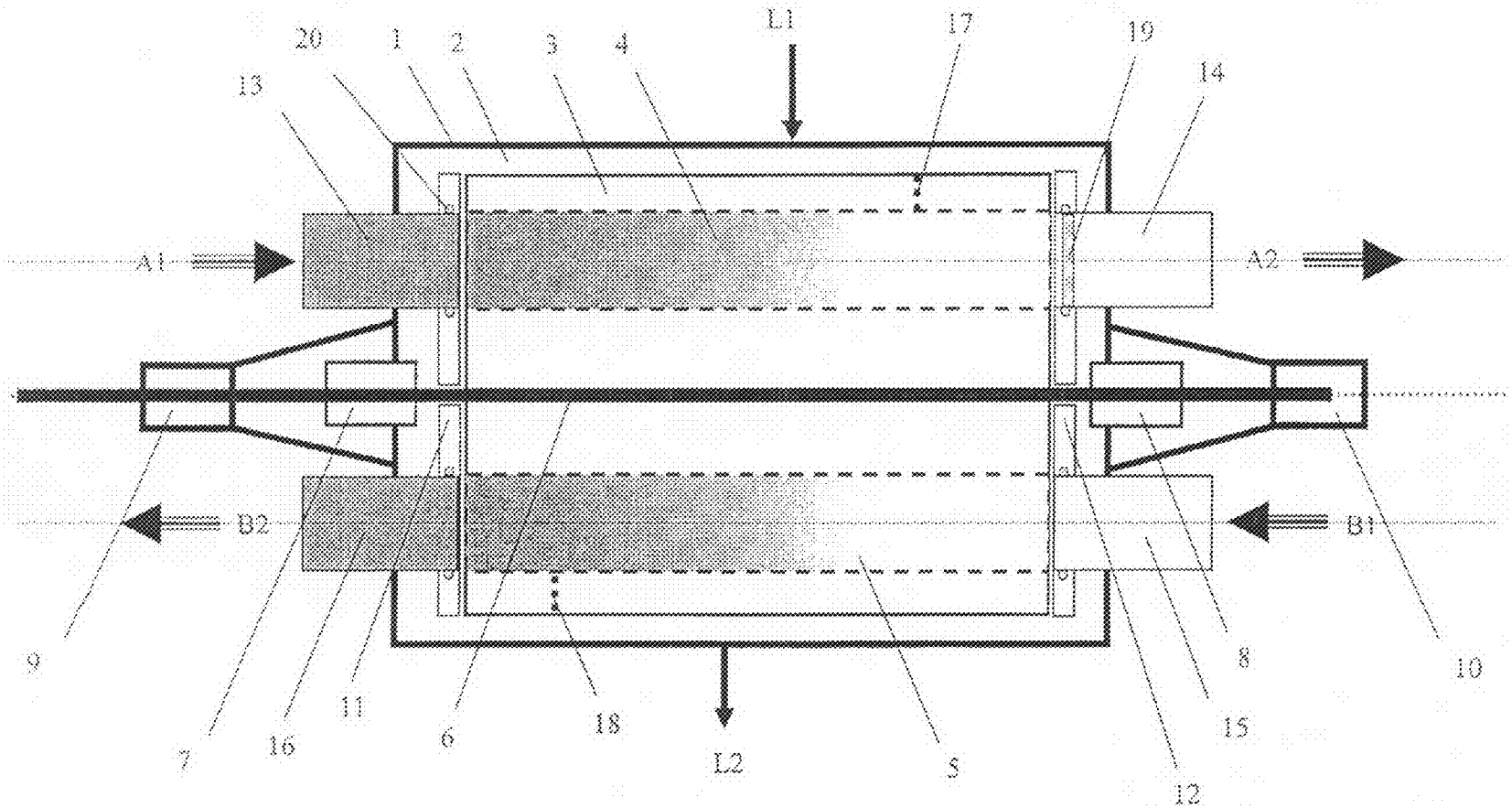
FIG. 1 is a side, elevational, schematic, cross-sectional view of a feeder according to the present invention.
Figure 2:
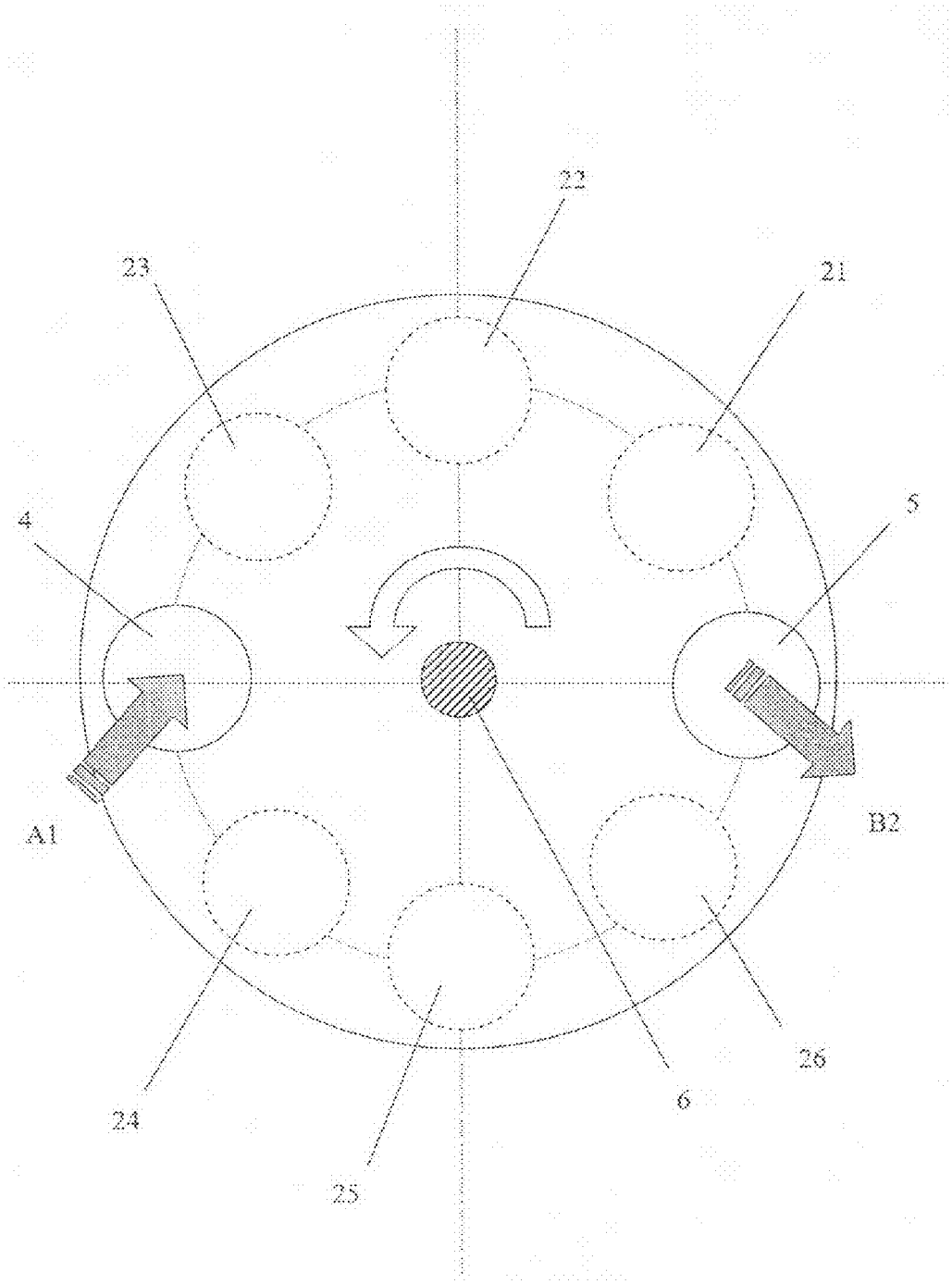
FIG. 2 is a front, elevational, schematic, cross-sectional view of a feeder according to the present invention.

In FIGS. 1 and 2 is schematically illustrated one possible construction of a feeder and a flow arrangement according to the present invention. FIG. 1 is a horizontal section of the feeder and FIG. 2 is a vertical section of same.

A feeder as shown in FIG. 1 has a volute casing (1) surrounding a chamber (2), which is pressurized. Casing (1) can be opened either horizontally or vertically (not shown in the figure) for maintenance.

Inside the casing (1) there is a rotor (3), which has a plurality of flow channels, two of which (4 and 5) are shown in FIG. 1. The flow channels run parallel to the shaft (6). The rotor (3) is fixed on the shaft (6). The shaft (6) is supported by the bearing units (9 and 10) in such a way that the shaft (6) and the rotor (3) can move freely in the axial direction of the shaft within certain limits. Alternatively, the end bearing can also be an axial bearing, which means that the shaft (6) cannot move. On the shaft (6) at both ends of the casing, there is a sealing system (7, 8), which prevents leakage from the casing (1). This sealing system (7, 8) can be e.g. a stuffing box or a mechanical seal. The casing (1) has two connections (13 and 14) for low-pressure circulation and two connections (15 and 16) for high-pressure circulation. According to the embodiment shown in FIG. 1, the low-pressure feed flow (A1) into the flow channel (4) flows through the connection for the low-pressure inlet (13) and the low-pressure feed flow (A2) out of the flow channel (4) flows through the connection for the low-pressure outlet (14). The high-pressure purge flow into (B1) the flow channel (5) flows through the connection for the high-pressure inlet (15) and the high-pressure purge flow out (B2) of the flow channel (5) flows through the connection for the high-pressure outlet (16). These connections (13, 14, 15, and 16) go through the casing (1) and are fixed to the casing (1) e.g. by welding, so there is no leakage out of the casing (1). In the feeder according to FIG. 1, there is a screen (19) inside the connection for the low-pressure outlet (14).

Inside the casing (1) there is one sealing plate (11, 12) at each of the ends of the rotor (3), between the rotor (3) and the casing (1). The connections (13, 14, 15, and 16) go through the sealing plates (11 and 12). Between the connections (13, 14, 15, and 16) and the sealing plates (11 and 12) seals are provided, e.g. O-rings (20). Sealing plates (11 and 12) can move axially, but they do not rotate. The chamber (2) inside the casing is pressurized by a pressurizing fluid flow (L1), which can be e.g. white liquor or compressed air. The pressure of the chamber (2) is equal to or higher than the pressure of the high-pressure purge flow (B1). A controlled flow of fluid (L2) out of the casing (1) may be used to control the pressure inside the chamber. The chamber pressure prevents shaft deflection because pressure against the rotor (3) is equal from all directions. This means that the shaft construction can be light and the radial bearing loads will be small because of the hydraulically balanced system. The chamber pressure pushes the sealing plates (11 and 12) against the rotor, and in this way reduces the leakage from the chamber (2) to the low-pressure circulation and to the high-pressure circulation.

Low-pressure flow (A1) moves the bulk material into the flow channel of the rotor while the channel aligns with the connection for the low-pressure inlet (13). This low-pressure flow (A1) displaces the previous channel contents (A2), which is clean liquid originating from the high-pressure transfer flow (B1). Simultaneously, the high-pressure liquid flow (B1) displaces the bulk material from another flow channel (5), currently aligning with the connections for the high-pressure inlet (15) and outlet (16), as a high-pressure flow (B2). In this way, the feeder transfers the bulk material from the low-pressure system (flow A1) to the high-pressure system (flow B2), and clean fluid from high-pressure system (flow B1) to the low-pressure system (flow A2).

During the passage of flow channels (4 and 5) across the blind sectors of the sealing plates (11 and 12) there is no flow in the channels. To dampen the pressure shocks of the stopping flows (A1) and (B1), adjustable pressure equalizing openings (17 and 18) connecting the flow channels (4 and 5) to the chamber (2) outside the rotor (3) are provided according to the embodiment shown in FIG. 1. The size of the pressure equalizing openings (17 and 18) can be adjusted through an opening (not shown) in the casing (1). With the adjustable pressure relief connections (17 and 18), the size of the openings (17 and 18) can easily be optimized for different process conditions.

In FIG. 2 is shown a vertical cross section of the feeder of FIG. 1. In the embodiment shown, there are eight flow channels (4, 5, and 21-26) in the rotor. Flow channel (4) is in an open position relative to the low-pressure side of the feeder, aligning with the connections for the low-pressure inlet (13) and the outlet (14), and the flow channel (5) is at an open position relative to the high-pressure side of the feeder, aligning with the connections for the high-pressure inlet (15) and the outlet (16).

The number of the flow channels depends on the required capacity of the feeder, on the flow rates, on the rate of rotation of the rotor and on the properties of existing equipment. Given the necessary process variables, the person skilled in the art can easily determine the required amount of flow channels. Preferably, the flow channels inside the rotor are straight, with a constant cross-sectional area, enhancing the filling and emptying of the channels. The cross-sectional shape of the channels may be circular, elliptical, octagonal or any other suitable shape; preferably it is circular. Also the length and the diameter of the flow channels may be calculated by the skilled person, taking into account the different aspects and variables of the process as a whole. The rotor can be rotated continuously or stepwise. If the rotor is rotated continuously, the rate of rotation is in relation to the length of the feeder; generally, the longer the feeder is, the slower is the rate of rotation. On the other hand, the weight of the rotor increases with the length of the flow channels. The wear of the sealing plates (11 and 12) and the ends of the rotor (3) is less the slower is the rate of rotation. On the other hand, the heavier the feeder is the more supporting basement is also needed, leading to higher building costs. The replacement of sealing plates means a break in production, but maintenance of the feeder according to the present invention with axially movable sealing plates and with a cylindrical form of the casing (1) is quite easy, fast and can be done at the site of operation during scheduled shutdowns. As a summary of the above, the number of flow channels and the length of the flow channels as well as the rate of rotation of the rotor and the flow rates are questions of optimization and can be determined by a skilled person by utilizing the process parameters.

The flow channels (4, 5, and 21-26) are typically placed on the outer edge of the rotor (3). The rotor (3) is fixed on the shaft (6). The space outside the flow channels (4, 5, and 21-26) and the shaft (6) inside the rotor (3) can be closed or the support of the flow channels (4, 5, and 21-26) is arranged by other suitable means, for example by support grids.

The axially movable and floating sealing plates (11 and 12) can be coated on both sides with a suitable low-friction material, for example DryOnyx Z from Metso Paper. Alternatively the sealing plates (11 and 12) can be made of a suitable low-friction material, e.g. a low-friction alloy. The wear of the sealing plates is uneven and at some point the sealing efficiency becomes insufficient. According to the present invention, design of the sealing plates enables the use of both sides of the sealing plates, by turning the plates around. Also the ends of the rotor (3) can be coated with a suitable low-friction material, or the rotor (3) can be partly or wholly made of such material. According to one embodiment of the present invention, the sealing plates (11 and 12) and the ends of the rotor are coated with different materials having different wear properties, or alternatively the sealing plates (11 and 12) and the rotor (or the ends thereof) are made of different materials having different wear properties. For example, the easily replaceable sealing plates (11 and 12) can be coated with or made of a material with weaker wear resistance than the material or coating of the ends of the rotor (3).

As stated above, a screen (19) may be arranged inside the connection for low-pressure outlet (14). The use of the screen and the mesh size depend on the material to be transferred. The screen prevents the particles of bulk material from escaping from the flow channel as the channel is filled, enhancing the filling efficiency, but on the other hand the screen may cause cavitation and thus reduce the filling efficiency. The mesh size of the screen also has an effect on cavitation. Preferably, a screen as described is not provided in a feeder according to the present invention.

Figure 3:
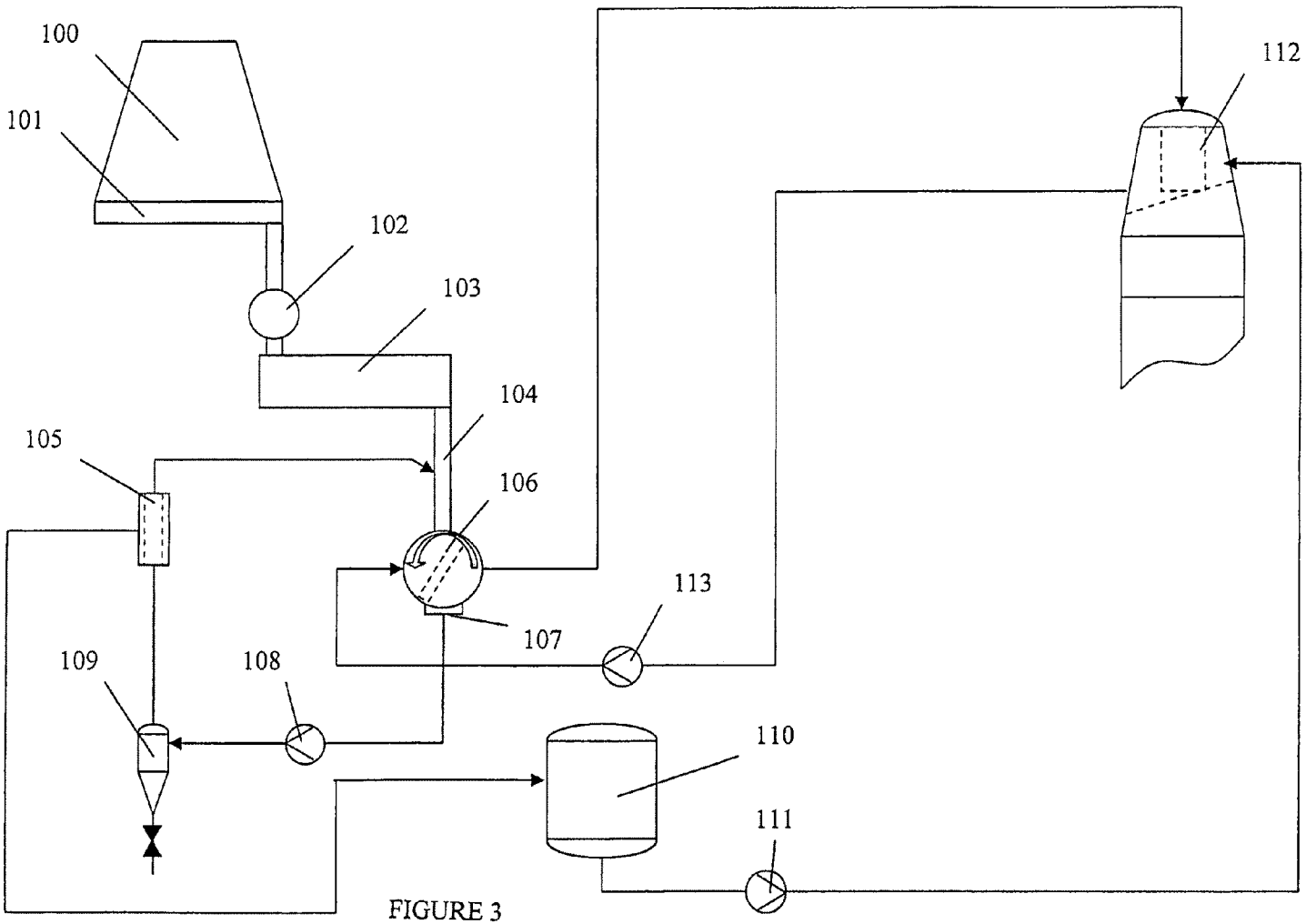
FIG. 3 is a schematic representation of a typical operating environment of a High Pressure Feeder according to the prior art.

FIG. 3 shows a typical operating environment of a High Pressure Feeder according to the prior art in a typical continuous digesting system. In an atmospheric chip bin (100), the chips are heated to about 100° C. A chip metering device (101), for example a screw, is used to measure the flow of chips fed to the process. By means of a transfer device, e.g. a low-pressure feeder (102) the chips are fed into the following pressure zone. In the steaming vessel (103), the chips are steamed for air and gas removal at a temperature of 110-125° C. In the chip chute (104) the chips are mixed with liquid coming from the in-line strainer (105). In a pocket feeder, e.g. a high-pressure feeder (106) the pressure of the chips is changed from the lower pressure to the higher process pressure. The bottom screen (107) of the high-pressure feeder (106) keeps the chips inside the feeder (106). The chip chute pump (108) transfers the chip chute circulation liquor from the chip chute (104) through the high-pressure feeder (106), through the sand separator (109) and through the in-line strainer (105) back into the chip chute (104). In the in-line strainer (105) excessive liquor is removed from the chip chute circulation and fed into the level tank (110). Level tank (110) is a buffer tank and provides the required suction head to the make-up liquor pump (111). Make-up liquor pump (111) pumps the liquid from the low-pressure level tank (110), raising its pressure. In the top separator (112), liquor is separated from the chip flow. The top circulation pump (113) pumps the liquid from the top separator (112) into the high-pressure feeder (106) and thus flushes the chips from the feeder's pockets into the top separator (112).

Figure 4:
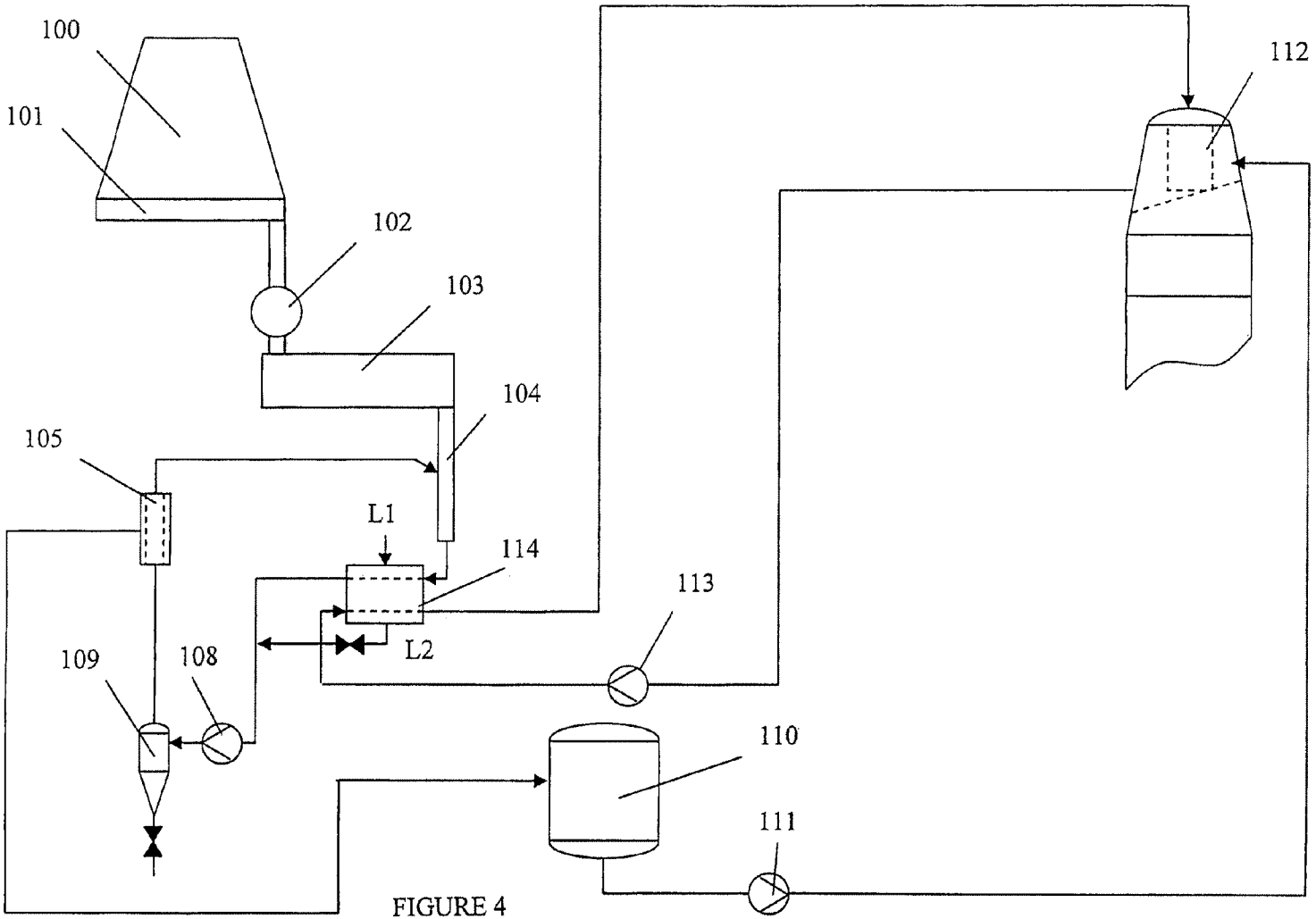
FIG. 4 is a schematic representation of a typical operating environment of a feeder according to the present invention.

In FIG. 4, the HPF of FIG. 3 is replaced with a feeder (114) according to the present invention, illustrating a typical operating environment of the feeder when transferring low-pressure slurry from the chip chute to the high-pressure digester in a continuous digesting system. According to FIG. 4, in the chip chute (104) the chips are mixed with liquid coming from the in-line strainer (105). The low-pressure slurry from the chip-chute (104) flows through the connection for low-pressure inlet into a flow channel, simultaneously pushing out the previous contents of the channel through the connection for low-pressure discharge. The chip chute pump (108) pumps the chip chute circulation liquor from the chip chute (104) through the feeder (114), through the sand separator (109) and through the in-line strainer (105) back into the chip chute (104). In the in-line strainer (105) excessive liquor is removed from the chip chute circulation and fed into the level tank (110). The chamber of the feeder (114) is pressurized by a fluid entering at (L1) and the chamber pressure can be controlled by fluid flow (L2) out of the casing. The pressure controlling fluid flow (L2) can be pumped by the chip chute pump (108) through the sand separator (109) and through the in-line strainer (105) to the chip chute (104). When the flow channel filled with low-pressure slurry comes into an open position, aligning with the connections for high-pressure circulation, the high-pressure liquid coming from the digester through the top circulation pump (113) flows into the feeder (114) through the connection for high-pressure inlet and displaces the slurry from the flow channel through the connection for high-pressure discharge into the top separator (112), simultaneously filling the flow channel with high-pressure liquid.

The feeder (114) shown in FIG. 4 operates according to the last-in-first-out principle, meaning that the slurry entering the flow channel last flows out of the channel first. Also the first-in-first-out feed and purge sequence is possible if the pipelines are connected in a different way with the connections of the feeder (114).

The chamber of the feeder (114) is pressurized by liquid flow (L1). In the case of a continuous pulp digesting system as shown in FIG. 4, the liquid may be white liquor, cooking liquor, black liquor, wash liquor, water or a mixture of any of these.

Figure 5:
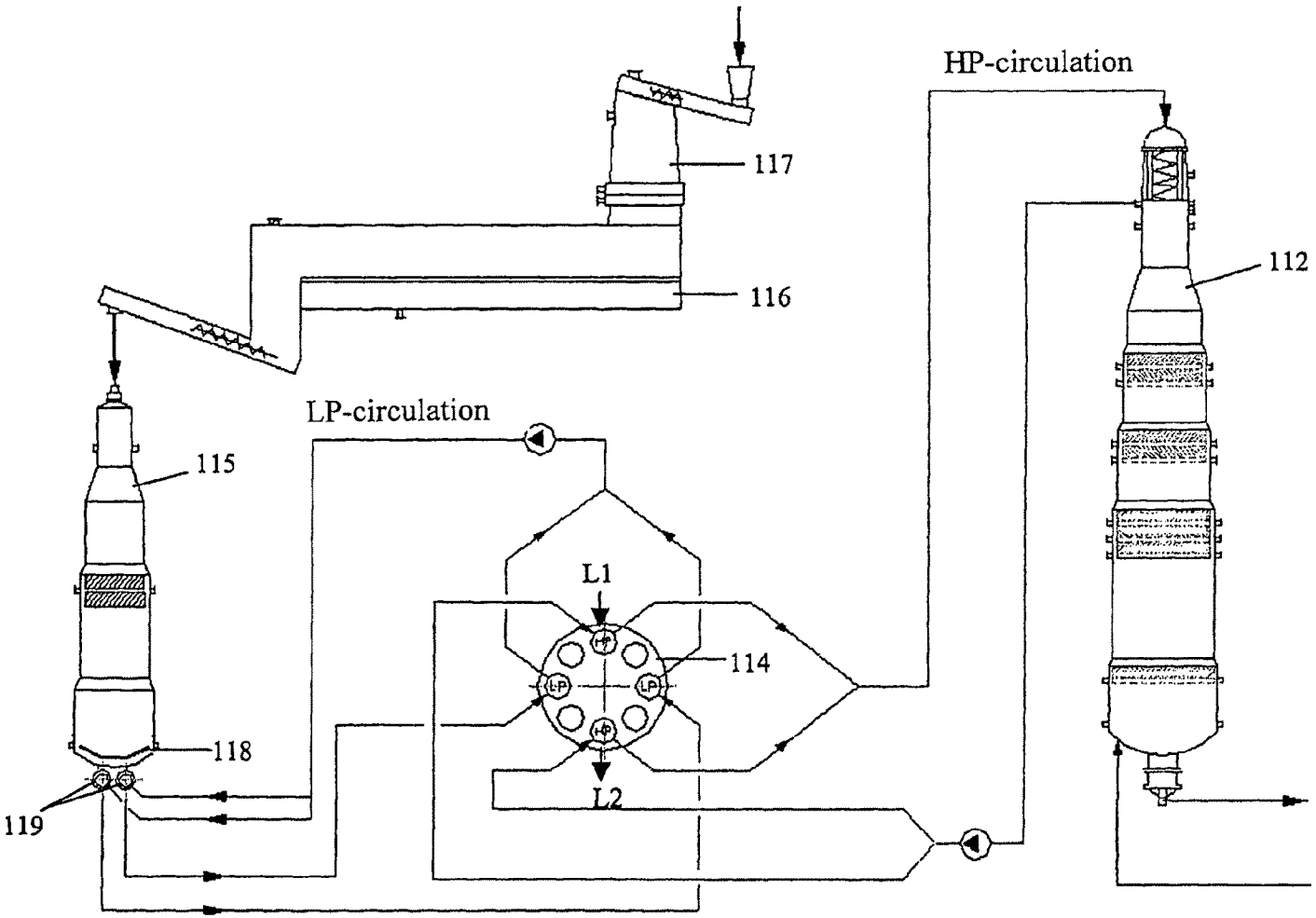
FIG. 5 is a schematic representation of a typical operating environment of a feeder according to the invention with two connections for low-pressure inlet and two connections for high-pressure outlet

In FIG. 5 is shown another typical operating environment of a feeder (114) according to the present invention. In this continuous digesting system the wood chips are impregnated before transferring to the high-pressure digester (112). The transfer device (114) according to FIG. 5 has two connections for low-pressure inlet and two connections for low-pressure outlet, or in other words four connections for low-pressure circulation (LP-circulation). Correspondingly, the feeder (114) has two connections for high-pressure inlet and two connections for high-pressure outlet, or in other words four connections for high-pressure circulation (HP-circulation). In this manner, the capacity of the feeder can be enhanced by minimizing the time for passage of the flow channels across the blind sectors of the sealing plates. The number of connections can also be more, e.g. six connections for low-pressure circulation and six connections for high-pressure circulation.

The wood chips enter the process from a steaming system, comprising a vertical vessel (117) in which the chips are warmed up by steaming, and a horizontal vessel (116), equipped with a flat bed conveyor on the bottom. During movement of the chips in the horizontal vessel (116) air is removed. This steaming system is called SUPER-STEAMER®, a patented system and a trademark of Metso Paper. The steaming system can however be any other system known by the person skilled in the art. Steamed wood chips are fed to the impregnation vessel (115). The bottom of the impregnation vessel (115) is equipped with a scraper (118) and a screw feeder (not shown in the figure), which transports the impregnated wood chips to both sides of the bottom of the impregnation vessel (115) where the outlets (119) are positioned. The low-pressure slurry flows through two pipes to the feeder, and its two connections for low-pressure inlet, and into the two flow channels which are in open positions, aligning with the connections for low-pressure circulation. To avoid plugging the slurry is discharged from the impregnation vessel (115) through two outlets (119) and transferred to the feeder through two separate pipes. The low-pressure slurry from the impregnation vessel (115) pushes out the previous contents of the two flow channels through the connections for low-pressure discharge. The low-pressure outlet connections may be equipped with screens. The low-pressure liquor flows out of the feeder through two pipes, which are then combined in one pipe having about the same surface area of their cross-sections as the sum of the surface areas of the cross sections of the two pipes coming out of the feeder. By combining the pipes the transferring of the liquor can be performed with one pump. The low-pressure liquor flow is transferred back to the impregnation vessel. The flow is split into two separate flows (two pipes) before entering the impregnation vessel (115). The low-pressure liquid flow from the feeder enters the impregnation vessel through the two connections (not shown in the figure) located in the bottom of the impregnation vessel (115). Thus, there are four connections in the bottom of the impregnation vessel; two for outlet and two for inlet. By feeding the liquor through two separate connections it can be distributed better in the vessel. It is however possible that there is only one outlet and one inlet connection in the bottom of the impregnation vessel (115). Thus, the number of connections in the impregnation vessel (115) and in the feeder (114) can vary. Correspondingly, the pipelines can be arranged in any other possible way than that shown in FIG. 5, depending e.g. on the number of connections in the feeder (114) and in the impregnation vessel (115), on the layout of the devices and on other process variables.

The chamber of the feeder (114) is pressurized by a fluid entering at (L1) and the chamber pressure can be controlled by fluid flow (L2) out of the casing.

When the two flow channels filled with low-pressure slurry come into open positions, aligning with the connections for high-pressure circulation, the high-pressure liquid coming from the digester flows into the feeder (114) through the two connections for high-pressure inlet and displaces the slurry from the flow channels through the connections for high-pressure discharge, simultaneously filling the flow channels with the high-pressure liquid. The high-pressure liquid flow out of the digester is split into two separate flows before entering the feeder. On the other hand, the two high-pressure slurry flows out of the feeder are combined before entering the digester. When two separate flows are combined in one pipe the surface area of the cross section of the pipe has to be about the same as the sum of the surface areas of the cross sections of the pipes before their combination.

Use of the transfer device or feeder according to the present invention is not restricted to any particular material to be transferred or to any particular operating environment or to any field of industry. That is, the transfer device can be used to transfer any kind of bulk material e.g. dry material or slurry of wood chips. The transfer device according to the present invention acts as a pressure isolation valve between two different pressure systems. The present invention is not limited as to whether the pressure at which the incoming material is supplied is lower or higher than the pressure to which the material is discharged.

Although the field of application of the invented transfer device is not limited, an application of major importance is in the field of continuous pulping, and in particular the feeding of wood chips into the digester.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Fluid transfer apparatus comprising a rotatable shaft, a rotor having a first end and a second end affixed to said rotatable shaft for rotation therewith, said rotor including a plurality of axially extending flow channels extending through said rotor substantially parallel to said rotatable shaft, a plurality of flow connectors for connecting a low-pressure flow of fluid and a high-pressure flow of fluid into and out of said plurality of axially extending flow channels, a casing defining a chamber enclosing said rotor, a pair of axially movable sealing plates disposed between said first and second ends of said rotor and said casing, and pressurizing means for pressurizing said chamber by feeding a pressurizing fluid into said chamber, thereby pressurizing said rotor, said plurality of flow connectors and said pair of axially movable sealing plates, thereby forcing said axially removable sealing plates against said first and second ends of said rotor in order to reduce the leakage from said chamber to said high and low pressure flows of fluid in said axially extending flow channels.

2. The fluid transfer apparatus of claim 1 including seals for sealing said rotatable shaft.

3. The fluid transfer apparatus of claim 1 wherein said plurality of axially extending flow channels includes pressure equalizing openings communicating with said chamber through said rotor.

4. The fluid transfer apparatus of claim 3 wherein said pressure equalizing openings are adjustable.

5. The fluid transfer apparatus of claim 1 wherein said pressurizing means includes fluid flow means for controlling the flow of said pressurizing fluid out of said casing.

6. The fluid transfer apparatus of claim 1 including sealing members disposed between said plurality of flow connectors and said pair of axially movable sealing plates for preventing leakage therebetween.

7. The fluid transfer apparatus of claim 1 wherein said rotatable shaft is axially movable.

8. The fluid transfer apparatus of claim 1 wherein said plurality of flow connectors comprises four flow connectors.

9. The fluid transfer apparatus of claim 1 wherein said plurality of flow connectors comprising eight flow connectors.

10. A method for sealing a fluid transfer apparatus including a rotatable shaft, a rotor having a first end and a second end affixed to said rotatable shaft for rotation therewith, said rotor including a plurality of axially extending flow channels extending through said rotor substantially parallel to said rotatable shaft, a plurality of flow connectors for feeding said fluid at a first pressure into and out of said plurality of axially extending flow channels and purging said fluid at a second pressure into and out of said plurality of axially extending flow channels, said first pressure and said second pressure being different pressures, said method comprising providing a casing defining a chamber for enclosing said rotor, providing a pair of axially movable sealing plates between said first and second ends of said rotor and said casing, and pressurizing said chamber thereby pressurizing said rotor, said plurality of flow connectors, and said pair of axially movable sealing plates by feeding a pressurizing fluid into said chamber, thereby forcing said pair of axially movable sealing plates against said first and second ends of said rotor in order to reduce the leakage from said chamber to said high and low pressure flows of fluid in said axially extending flow channels.

11. The method of claim 10 including pressurizing said chamber at a pressure greater than said first pressure and said second pressure.

12. The method of claim 10 including pressurizing said chamber with a pressurizing fluid selected from the group consisting of white liquor, cooking liquor, black liquor, wash liquor, water, and mixtures thereof.

13. The method of claim 10 including pressurizing said chamber with a pressurizing fluid selected from the group consisting of gas and steam.

14. The method of claim 10 including removing said pressurizing fluid from said chamber.

15. The method of claim 10 including feeding said fluid at said first pressure and purging said fluid at said second pressure in accordance with the last-in first-out principle.

16. The method of claim 10 including feeding said fluid at said first pressure and purging said fluid at said second pressure in accordance with the first-in last-out principle.

* * * * *

UNITED STATES PATENT AND TRADEMARK OFFICE

CERTIFICATE OF CORRECTION

PATENT NO. : 8,025,760 B2
APPLICATION NO. : 11/989702
DATED : September 27, 2011
INVENTOR(S) : Lasse Hernesniemi et al.

It is certified that error appears in the above-identified patent and that said Letters Patent is hereby corrected as shown below:

Column 5, line 30, after "T" insert --he method is characterized by the features stated in the characterizing part of claim 6.--

Signed and Sealed this
Ninth Day of October, 2012

David J. Kappos

David J. Kappos
*Director of the United States Patent and Trademark Office*